US005133321A

United States Patent [19]

Hering et al.

[11] Patent Number: 5,133,321

[45] Date of Patent: Jul. 28, 1992

[54] INTEGRATED THROTTLE CONTROL AND IDLE VALIDATION SENSOR

[76] Inventors: Charles A. Hering, 2004 SW. Moss St., Portland, Oreg. 97219; David A. Schaller, 5939 Hallowell Pl., Fort Wayne, Ind. 46815-6214

[21] Appl. No.: 698,671

[22] Filed: May 10, 1991

[51] Int. Cl.[5] ..... F02D 7/00

[52] U.S. Cl. ..... 123/399

[58] Field of Search ..... 123/399, 361, 339; 74/513; 180/197, 335

[56] References Cited

U.S. PATENT DOCUMENTS 4,703,823 11/1987 Yogo et al. ..... 180/197
4,883,037 11/1989 Mabee et al. ..... 123/399
4,958,607 9/1990 Lundberg ..... 123/399

*Primary Examiner*—Raymond A. Nelli
*Attorney, Agent, or Firm*—Robert L. Harrington

[57] ABSTRACT

An integrated throttle control and idle validation sensor includes mechanically coupled but electrically independent throttle control and idle validation components. A single mechanical input to the protective sensor housing corresponds to an accelerator pedal position and causes selective coupling of a supply voltage to one of an idle validation conductor and a throttle validation conductor for interpretation by an electronic control system. The throttle control system within the sensor housing comprises a potentiometer adapted for movement corresponding to the mechanical input whereby a variable voltage throttle control signal may be delivered to the electronic fuel control system. The sensor integrates previous separate throttle control and idle validation functions into a single environmentally secure housing and requires no calibration. The disclosed throttle system is more reliable and less costly than previously available separate throttle control and idle validation functions.

14 Claims, 3 Drawing Sheets

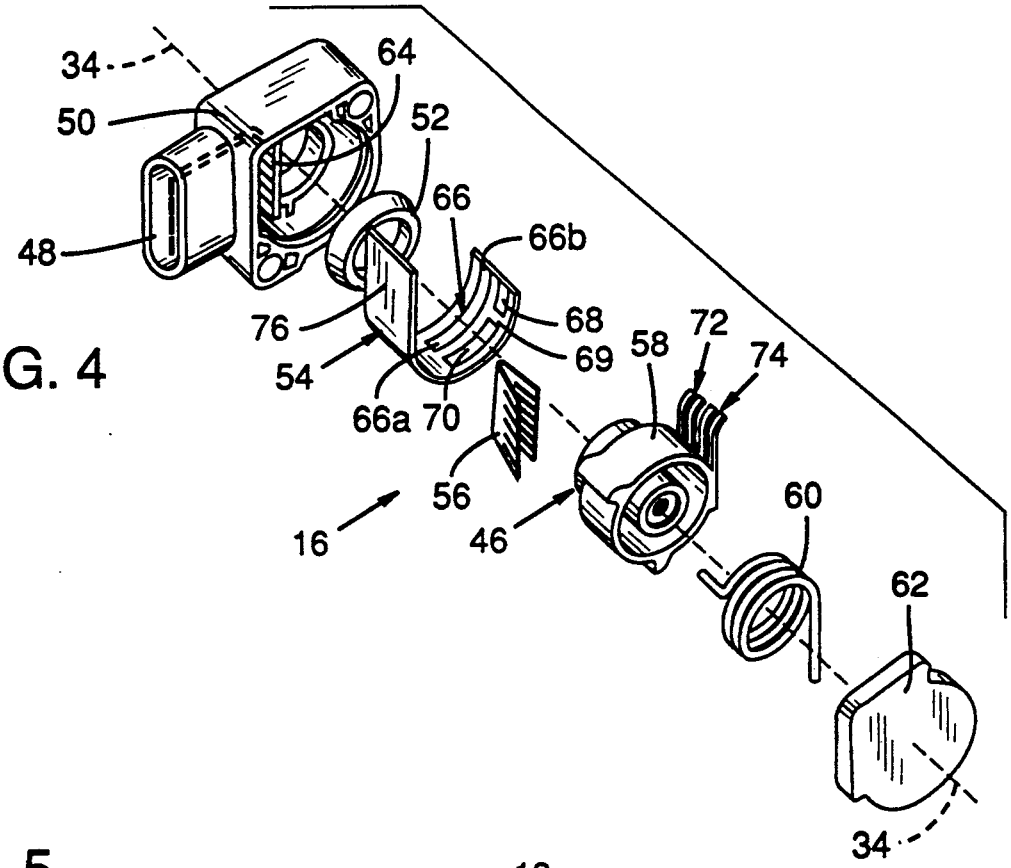
FIG. 4
FIG. 5
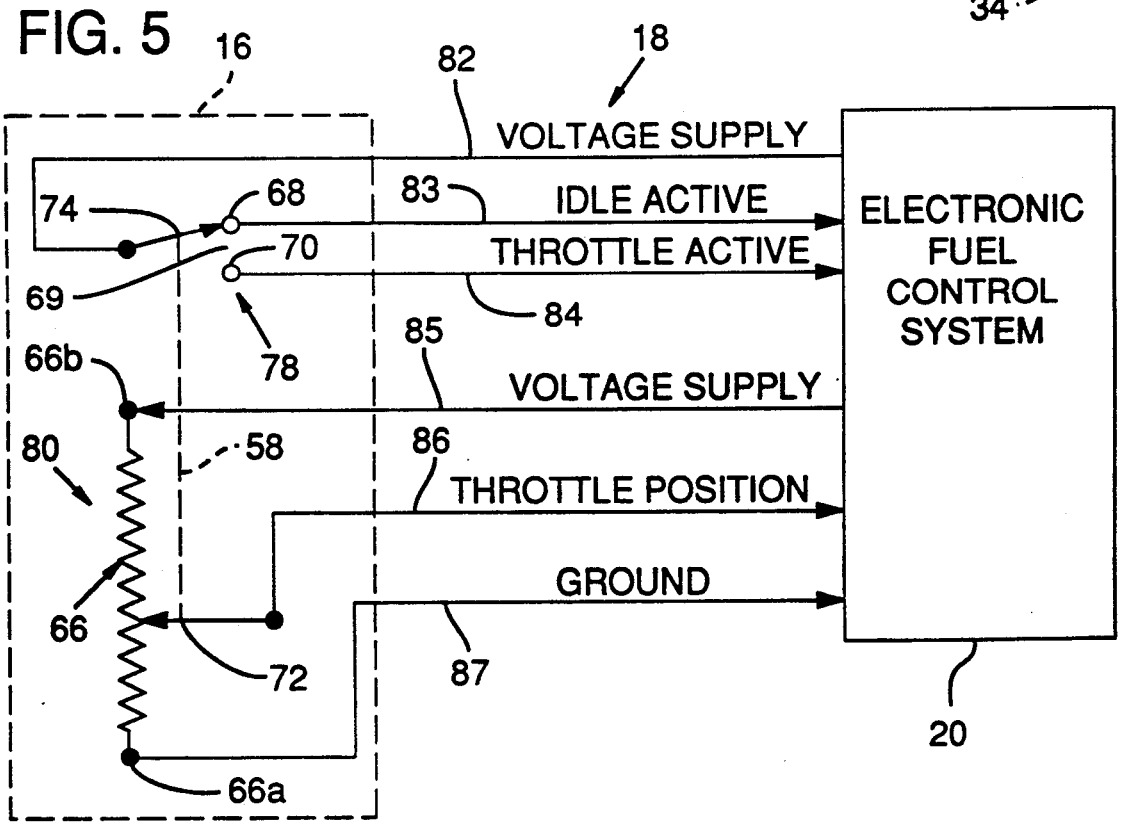

INTEGRATED THROTTLE CONTROL AND IDLE VALIDATION SENSOR

BACKGROUND OF THE INVENTION

The present invention applies to engine control systems and particularly to throttle control systems for electronic fuel control systems.

Many vehicle throttle control systems now use electrical circuitry to deliver an electrical signal from the accelerator, e.g. an accelerator pedal or hand control lever, to an electronic fuel control system. For example, a voltage signal provided to the electronic fuel control system corresponds to accelerator pedal or hand control position. When an "in-range" voltage level arrives at the electronic fuel control system, the electronic fuel control system responds by injecting a corresponding volume of fuel into the engine fuel system.

In some applications, a control device failure can result in an invalid in-range throttle condition, i.e. an unintended in-range voltage level. Under such condition, even though the accelerator control device is at an idle position, the electronic fuel control system receives an erroneous throttle control signal and undesirably injects fuel into the engine fuel system. Loss of engine throttle control, and possibly unintended vehicle acceleration, can result. To avoid such error conditions, a separate idle validation switch has been added to the accelerator control device as backup protection against such a failure. Typically, this switch provides a single pole double throw function wherein one side of the switch delivers a logic signal corresponding to valid idle operation only and the other side validates throttle operation. The switch mounts to the accelerator control device in such a way that actuation of the accelerator control changes the switch position from its idle validation position to its throttle validation position. The electronic fuel control system ignores the throttle control signal until it receives a throttle validation signal by way of the switch.

Accordingly, if an erroneous in-range throttle signal arrives at the electronic fuel control system, unintended fuel delivery is avoided because the electronic fuel control system has not yet received a throttle validation signal.

The idle validation switch attaches to the accelerator pedal or hand control as a separate component. The switch mounts to the accelerator control device in such manner to provide the switching according to pedal or hand control lever position. It is necessary to adjust or calibrate the point at which the switching occurs to coincide with a specified throttle signal level, i.e. a point of transition between idle and throttle operation. This insures that the switch is in the idle valid mode when the driver releases the accelerator control device, and that the engine will have a smooth idle to power transition when the driver applies the throttle. Switch transition points are typically specified by the engine manufacturer. Installation of the switch can be difficult because of the sensitive calibration required to meet the engine manufacturer's specifications, and the complex test procedures needed to insure that proper switch functioning occurs. Additionally, the switch must meet stringent environmental quality standards to function reliably in typical operating environments.

These factors result in an expensive idle validation switch and, in some cases, marginal product reliability. The resulting product is also virtually impossible to service in the field without replacing the entire accelerator control assembly. Such difficult field service further adds to the overall cost of such idle validation systems.

SUMMARY OF THE INVENTION

In accordance with a preferred embodiment of the present invention, an accelerator position sensor is combined in an integrated sensor package with mechanical registration of the validation switch and throttle control sensor built into the sensor. The accelerator position sensor and idle validation switch are electrically separate units, but mechanically coupled for response to a common actuation mechanism. The common mechanical connection establishes and maintains constant the required mechanical registration. The resulting integrated sensor can be installed on the control device without significant adjustment, or without calibration of the switch and sensor. Also, packaging of the idle validation switch in the sensor housing protects the switch from its environment, and thereby increases its reliability. The integrated package thereby enjoys reduced number of parts, increased reliability and serviceability, and reduced overall cost.

BRIEF DESCRIPTION OF THE DRAWINGS

For a better understanding of the invention, and to show how the same may be carried into effect, reference will now be made, by way of example, to the accompanying drawings in which like reference numerals refer to like elements.

FIG. 4 is an exploded view of the sensor of FIG. 3.

FIG. 5 is a schematic diagram of the sensor and electronic fuel control system showing electronic coupling.

DETAILED DESCRIPTION

Figure 1:
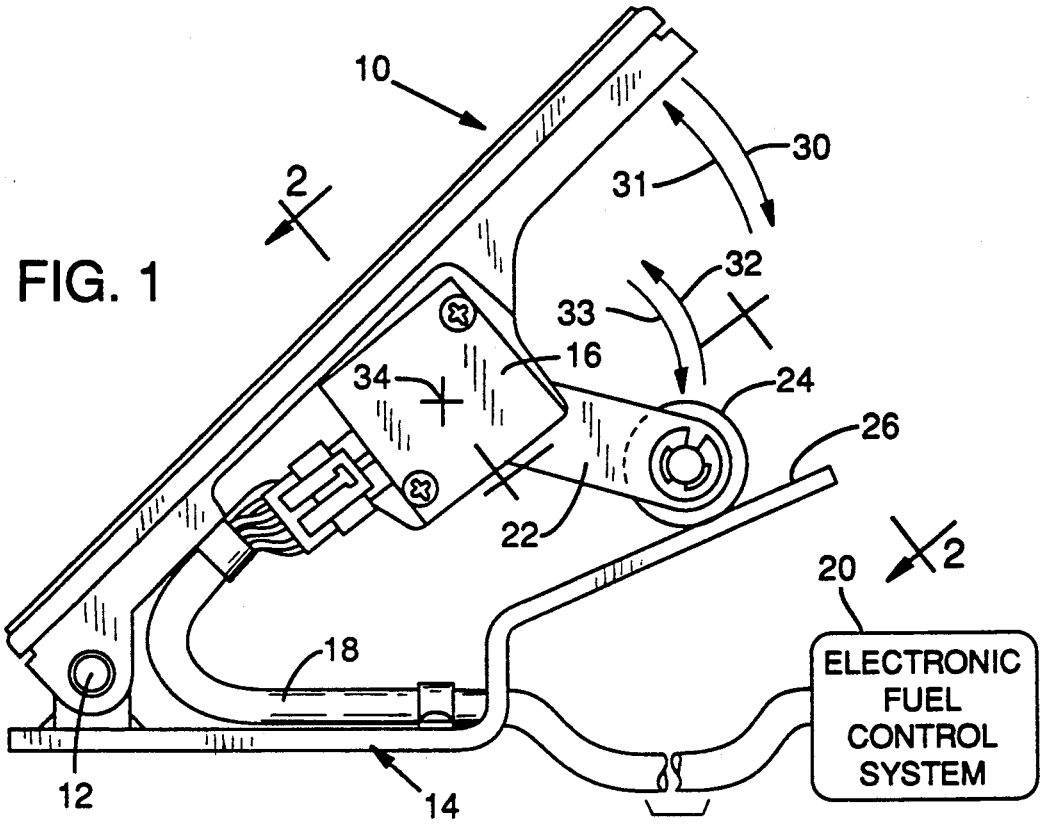
FIG. 1 is a side view of an accelerator pedal, an integrated throttle control and idle validation sensor, and an electronic fuel control system.

FIG. 1 shows a fuel control device, i.e., an accelerator pedal 10, pivotally coupled at pin 12 to a base plate 14. Base plate 14 attaches to the floor of a vehicle (not shown) in conventional manner. An integrated throttle control and idle validation sensor 16 mounts to the underside of pedal 10 for the combined functions of providing a throttle control signal, an idle validation signal, and a throttle validation signal. Sensor 16 couples by way of multi-conductor cable 18 to an electronic fuel control system 20. System 20 is a conventional control system, and in the illustrated embodiment corresponds to a Cummins electronic fuel control system available under the trade name CELECT. While illustrated with reference to a specific electronic fuel control system, it will be appreciated by those skilled in the art that sensor 16 may be adapted to operate with a wide variety of electronic fuel control systems and control devices.

A lever arm 22 pivotally mounts to sensor 16 and carries a roller 24 at its distal end. Base plate 14 includes an inclined surface 26 engaged by roller 24. As the operator depresses pedal 10 to accelerate the vehicle, pedal 10 rotates about pin 12 in the direction 30, clockwise in the view of FIG. 1. As roller 24 moves upward along surface 26 in response to downward actuation of pedal 10, lever arm 22 pivots in the direction 32, counter clockwise in the view of FIG. 1, about the axis 34. Sensor 16 detects such movement of lever arm 22 and delivers to system 20 by way of cable 18 suitable signals both indicating and validating the position of pedal 10.

Figure 2:
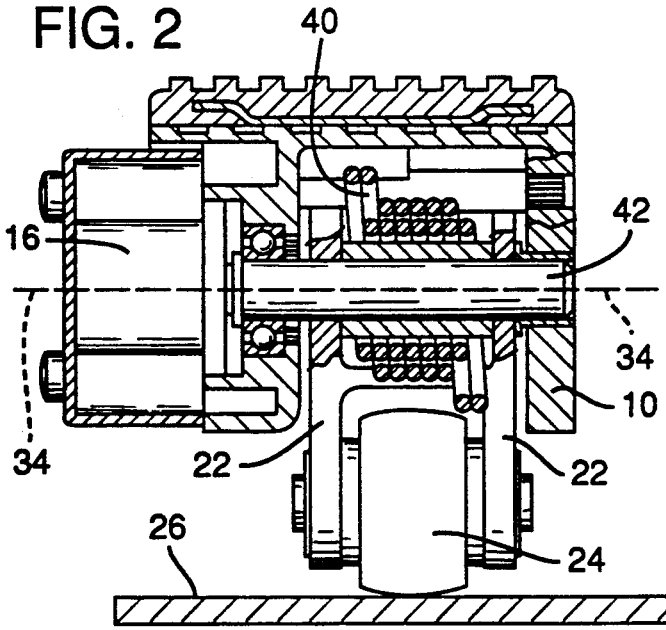
FIG. 2 is a sectional view of the pedal and sensor of FIG. 1 taken along lines 2—2 of FIG. 1.

FIG. 2 shows a sectional view of the assembly of FIG. 1 taken through the sensor 16 and arm 22. In FIG. 2, a double spring 40 encircles a shaft 42 mounted upon the body of pedal 10 for rotation about the axis 34. Spring 40 couples the underside of pedal 10 and lever arm 22 to bias lever arm 22 in the direction 33 opposite that of direction 32. Pedal 10 is thereby spring biased in the direction 31, opposite of direction 30, and toward the idle position as shown in FIG. 1. The shaft 42, pivotally mounts to the body of pedal 10, but fixedly attaches to lever arm 22 such that movement of pedal 10 results in rotation of shaft 42 relative to sensor 16 and about the axis 34. Sensor 16, being mechanically coupled to shaft 42, responds to rotation of shaft 42 by producing the desired throttle control, idle validation, and throttle validation signals according to pedal 10 position as described hereinafter.

Figure 3:
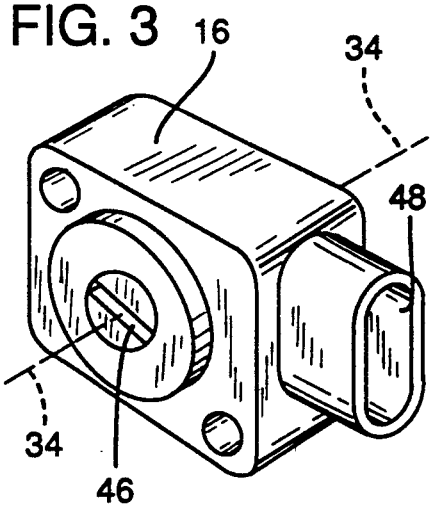
FIG. 3 is a perspective view of the integrated throttle control and idle validation sensor of FIG. 1.

FIG. 3 shows in perspective the throttle control and idle validation sensor 16. Sensor 16 includes a slot formation 46 for mechanical coupling to shaft 42 and an electrical connector formation 48 for electrical coupling to multi-conductor cable 18. Shaft 42 engages slot formation 46 and rotates slot formation 46 about the axis 34 as a mechanical input to sensor 16. Movement of pedal 10 about pin 12 results in mechanical input, by way of shaft 42, to sensor 16 at slot formation 46. In response, sensor 16 generates the necessary signals at the connector formation 48 for delivery by way of cable 18 to electronic fuel control system 20. It will, therefore, be appreciated by those skilled in the art that sensor 16 provides an integrated package receiving a mechanical input and developing suitable electrical outputs. Sensor 16 requires no calibration for idle validation relative to throttle control as such is built into the integrated package. Also, by enclosing the throttle control and idle validation functions in the housing of sensor 16, the risk of exposure to environmental conditions, possibly effecting operation of sensor 16, is eliminated.

FIG. 4 is a view of sensor 16 exploded along the axis 34. In FIG. 4, sensor 16 comprises an external housing 50, a seal 52, a printed circuit element 54, a termination wedge 56, a rotor 58, a spring 60, and a cover 62. Within housing 50, a terminal structure 64 carries conductive elements, corresponding to those of cable 18, from within the connector formation 48 to the interior of housing 50. As described more fully below, the printed circuit element 54 includes a resistive element 66, an idle conductive element 68, and a throttle conductive element 70 suitably etched onto the substrate of circuit element 54. The rotor 58 includes a throttle wiper 72 and an idle/throttle validation wiper 74. In assembly of sensor 16, seal 52 first inserts within housing 50, then circuit element 54 rests within housing 50 such that elements 66, 68, and 70 of circuit element 54 face inward. A flat portion 76 of printed circuit element 54 rests adjacent the terminal structure 64. Circuit element 54 includes additional conductive traces (not shown) for coupling elements 66, 68, and 70 to suitable terminal contact points (not shown) of flat portion 76. The termination wedge 56 suitably interconnects the elements 66, 68, and 70 of element 54, by way of the terminal contacts (not shown) of flat portion 76, with the conductors of terminal structure 64. Electrical coupling between individual conductors of cable 18 and portions of circuit element 54 is thereby established.

Rotor 58 inserts within housing 50 interior of circuit element 54 and the wipers 72 and 74 contact portions of circuit element 54. More particularly, the throttle wiper 72 contacts the resistive element 66 of circuit element 64 and the idle/throttle validation wiper 74 selectively contacts one of, or neither of, the idle conductive element 68 and the throttle conductive element 70. Seal 52 seal rotor 58 within housing 50 while allowing rotation about the axis 14. Spring 60 couples rotor 58 and housing 50 to suitable bias rotor 58 toward a full return position. Cover 62 attaches to housing 50 to rotatably support rotor 54 and to seal the entire assembly. Rotor 58 includes the slot formation 46 (not shown but indicated by numeral 46 in FIG. 4). Rotor 58 then rotates within housing 50 and about the axis 34 according to rotation of shaft 42, i.e. in response to actuation of pedal 10. Throttle wiper 72 thereby moves along resistive element 66 while, for given ranges of angular position for rotor 58, validation wiper 74 contacts one of the idle validation conductive element 68, a non-conductive portion 69, or idle validation conductive element 70.

FIG. 5 illustrates electrical connections between portions of the sensor 16 and the electronic fuel control system 20 as established by the conductors of cable 18. In FIG. 5, the validation wiper 74 together with conductive elements 68 and 70 and non-conductive portion 69 comprise a switch 78. The resistive element 66 and throttle wiper 72 comprise a potentiometer 80. Switch 78 and potentiometer 80 are mechanically coupled by way of rotor 58, but are electrically separate. A voltage supply conductor 82 of cable 18 connects, by way of structure 64, wedge 56, and conductive traces of circuit element 54, to wiper 74, i.e. to the common pole of switch 78. An idle active conductor 83 of cable 18 couples in similar manner to idle conductive element 68. A throttle active conductor 84 of cable 18 similarly couples to throttle conductive element 70. Switch 74 selectively routes the supply voltage present on conductor 82 to neither or one of cable conductors 83 and 84 for interpretation by electronic fuel control system 20. A supply voltage potential on idle active conductor 83 validates an idle position for pedal 10 while a supply voltage potential on throttle active conductor 84 validates an in-range throttle control signal. A supply voltage on neither of conductors 83 and 84, i.e., an open connection, indicates to system 20 a transition between an idle active and throttle active condition to pedal 10.

A second voltage supply conductor 85 of cable 18 delivers a supply voltage to end **66*b* of resistive element 66 while a ground conductor 87 of cable 18 connects to the opposite end 66*a* of resistive element 66 as a ground return to electronic fuel control system 20. A throttle position conductor 86 of cable 18 couples to wiper 72 of potentiometer 80 whereby the voltage potential on throttle position conductor 86 corresponds to the position of wiper 72, more particularly, to the position of pedal 10**.

As noted above, the switch 78 and potentiometer 80 are mechanically coupled by way of rotor 58. As rotor 58 moves from its full return position through a given range of angular movement, corresponding to full actuation of pedal 10, wiper 72 moves from near end 66b toward end 66a of resistive element 66. Concurrently with such rotation of rotor 54, wiper 74 initially contacts conductive element 68, but as rotor 54 moves through a given angular transition zone range, it disengages conductive element 68 as it rests against non-conductive portion 69. At the end of this transition zone range, wiper 74 contacts conductive element 70. Thus, rotation of rotor 54 through its angular range of motion corresponds to a continuously variable voltage signal on throttle position conductor 86, and suitable presentation of discrete logic signals on idle active conductor 83 and throttle active conductor 84.

In the preferred embodiment, rotor 54 has a full range of approximately 70 degrees of rotation corresponding to movement of pedal 10 from idle to full acceleration. The transition zone range, between idle validation and throttle validation, is determined by the extent of non-conductive portion 69 of circuit element 54 separating conductive elements 68 and 70. As will be apparent to those skilled in the art, a variety of configurations for sensor 16 will yield a variety of rotor 54 movement ranges and transition zone ranges a desired.

Figure 6:
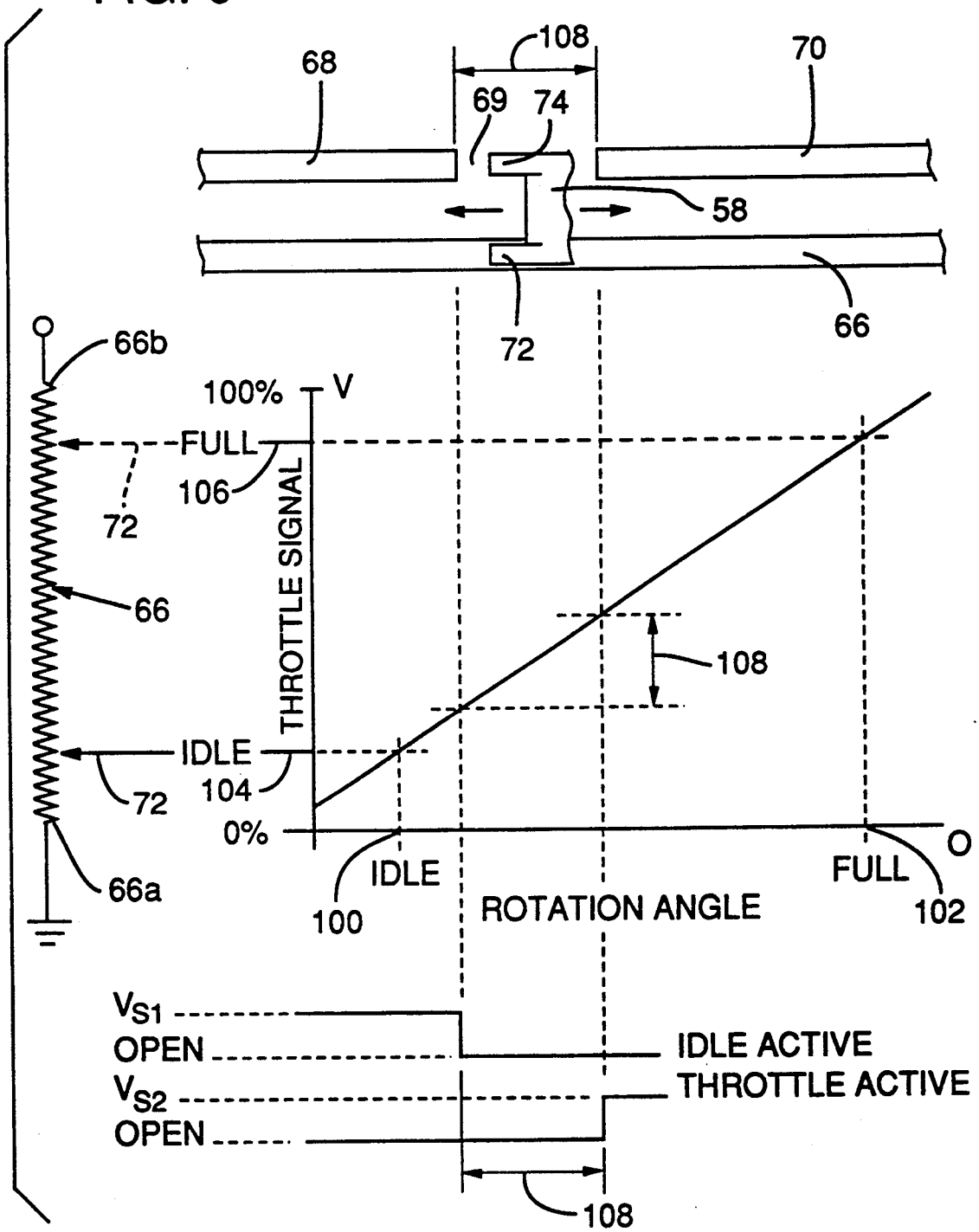
FIG. 6 illustrates the relationship between mechanical operation of the sensor and production of the throttle control signal, idle validation signal and throttle validation signal.

FIG. 6 relates the wiper 72 position in terms of a rotation angle of rotor 58 on the horizontal axis to the throttle control signal voltage, on the vertical axis, delivered to electronic fuel control system 20 by way of conductor 86. As the angular position of rotor 58 moves from an idle position 100 to a full throttle position 102, the voltage at wiper 72 ramps linearly from an idle voltage 104 to a full throttle voltage 106. The wiper 74 similarly moves from contact with idle conductive element 68 through a transition zone 108 and on to contact with throttle conductive element 70. Thus, as rotor 58 moves from its idle position 100 to its full throttle position 102, the voltage on conductor 83 of cable 18, representing an idle active signal, remains at the supply voltage $V_{s1}$ until wiper 74 loses contact with conductive element 68. At this time the idle active conductor 83 of cable 18 presents an open circuit to system 20. Continuing with rotation of rotor 58 toward the full throttle position 102, wiper 74 eventually contacts conductive element 70 whereat the voltage on conductor 84 of cable 18, representing a throttle active signal, moves from being open to the supply voltage potential $V_{s2}$.

Electronic fuel control system 20 monitors the throttle position conductor 86, idle active conductor 83 and throttle active conductor 84 of cable 18. A supply voltage potential on idle active conductor 83 validates the idle position for pedal 10 and system 20 ignores the signal on throttle position conductor 86. A supply voltage potential on throttle active conductor 84 validates an in-range throttle control signal on throttle position conductor 86 and an appropriate volume of fuel is delivered to the vehicle engine. An open circuit on both of conductors 83 and 84 indicates to system 20 a throttle transition between an idle condition and a throttle condition. System 20 reacts as programmed according to the necessary engine specification requirements for transition between idle and throttle.

Thus, an integrated throttle control and idle validation sensor has been shown and described. The integrated package reacts to accelerator pedal position by way of a single mechanical input and delivers suitable electrical signals by way of cable 18 to an electronic fuel control system. The sensor and validation switch enjoy protection from environmental conditions, i.e. the cab environment, by virtue of its integrated packaging. Also, installation of sensor 16 requires no calibration between the throttle control portions, i.e. wiper 72 and resistive element 66, and the idle validation portions, i.e. the wiper 74 and conductive elements 68 and 70.

It will be appreciated that the present invention is not restricted to the particular embodiment or application that has been described and illustrated and that many variations may be made therein without departing from the scope of the invention as found in the appended claims and the equivalents thereof. For example, while the invention has been shown for a foot operated accelerator pedal, it should be apparent that the invention may be applied to a variety of control devices where separate validation signals are desired.

We claim:

1. A throttle control and validation sensor for sensing an accelerator control device position and providing a control device position signal and a position validation signal each representing control device position, the sensor comprising:

a sensor housing;

mechanical input means corresponding to accelerator control device position for delivering interior of said housing a mechanical indication of accelerator control device position;

integrated sensor and validation means within said housing, mechanically coupled in common to said mechanical indication of accelerator control device position, and responsive thereto for generating said position signal and said validation signal; and signal delivery means making available said position signal and said validation signal exterior of said housing.

2. A sensor according to claim 1 wherein said position signal is a continuous signal identifying an accelerator control device position relative to a full control device position range.

3. A sensor according to claim 1 wherein said validation signal is a discrete signal identifying accelerator control device position within a given range of control device positions, said given range being less than a full range of control device positions.

4. A sensor according to claim 3 wherein said given range of control device positions corresponds to an idle condition of said control device.

5. A sensor according to claim 1 wherein said validation signal identifies accelerator control device position within a plurality of control device position ranges, each of said plurality of ranges being less than a full control device position range and mutually exclusive thereamong.

6. A sensor according to claim 5 wherein a first range of said plurality of ranges corresponds to an idle condition of said control device and a second one of said ranges corresponds to non-idle throttle condition of said control device.

7. A sensor according to claim 1 wherein said housing is adapted to protect said integrated sensor and validation means against environmental conditions surrounding said housing.

8. An integrated throttle control sensor and idle validation sensor for an apparatus having an accelerator control device and electronic fuel control system, the accelerator control device being manually positionable to indicate throttle control by way of said sensor to said electronic fuel control system, said sensor comprising:

housing means adapted for mounting to the accelerator control device and sealable to substantially isolate the interior of said housing against environmental conditions surrounding said sensor;

mechanical input means to said sensor wherein said mechanical input to said sensor corresponds to manual throttle control positioning of said control device;

sensor means within said housing and responsive to said mechanical input to generate an electrical throttle control signal corresponding to control device position and a bi-state electrical idle validation signal having a first state corresponding to an idle condition of said control device and a second state corresponding to a non-idle condition of said control device; and electrical output means making available said throttle control signal and said idle validation signal external of said housing for coupling to said electronic fuel control system.

9. A sensor according to claim 8 wherein said sensor means further produces a bi-state throttle validation signal having a first state corresponding to a throttle condition of said control device and a second state corresponding to a non-throttle condition of said control device, and wherein said electrical output means makes available external of said housing said throttle validation signal.

10. A sensor according to claim 8 wherein said mechanical input comprises a member rotatably mounted within said housing and having a range of rotation corresponding to a range of control device positions.

11. A sensor according to claim 8 wherein said sensor means comprises:

a potentiometer having a first wiper and a resistive element, the first wiper in contact with said resistive element, the resistive element carrying a first electrical potential thereacross whereby in response to said mechanical input said first wiper moves relative to said resistive element such that the electric potential at said first wiper corresponds to said throttle control signal; and a switch having a second wiper and a contact element, the second wiper carrying a second electrical potential and the contact element carrying said idle validation signal whereby in response to said mechanical input said second wiper moves in coordination with said first wiper and relative to said contact element such that said second wiper selectively couples said second electrical potential to said contact element according to control device position.

12. A sensor according to claim 11 wherein said mechanical input means comprises a body rotatable within said housing and carrying said first and second wipers for mechanical coupling and coordinated movement thereof.

13. A sensor according to claim 11 wherein said second wiper is adapted to selectively contact a second conductive element according to control device position whereby a throttle validation signal may be taken from said second conductive element, and wherein said electrical output means makes available said throttle validation signal exterior of said housing.

14. An integrated throttle control signal and idle validation sensor comprising:

sensor housing means adapted for mounting to an accelerator control device and sealable to substantially isolate the interior of said housing against environmental conditions surrounding said sensor;

mechanical input to the interior of said housing and adapted for movement corresponding to accelerator control device movement;

first conductive element interior of said housing;

second conductive element interior of said housing;

first wiper interior of said housing and adapted for selective electrical contact with said first and second conductive elements;

a resistive element interior of said housing;

second wiper element interior of said housing and adapted for electrical contact along the length of said resistive element; and mechanical coupling means interior of said housing and responsive to said mechanical input for relative coordinated movement of said first and second wipers relative to said first and second conductive elements and said resistive element, respectively, whereby movement of the accelerator control device from an idle position through a full throttle position corresponds to said first wiper contact with said first conductive element and subsequent contact with said second conductive element and continuous contact of said second wiper element with said resistive element.

* * * * *